US010633126B2

(12) United States Patent
Sain

(10) Patent No.: US 10,633,126 B2
(45) Date of Patent: Apr. 28, 2020

(54) MACHINE FOR POSITIONING THE FLAPS OF A BOX

(71) Applicant: BORTOLIN KEMO S.P.A., Porcia (IT)

(72) Inventor: Marino Sain, Roveredo in Piano (IT)

(73) Assignee: BORTOLIN KEMO S.P.A., Porcia (IT)

( * ) Notice: Subject to any disclaimer, the term of this patent is extended or adjusted under 35 U.S.C. 154(b) by 1022 days.

(21) Appl. No.: 14/202,530

(22) Filed: Mar. 10, 2014

(65) Prior Publication Data

US 2015/0151860 A1 Jun. 4, 2015

(30) Foreign Application Priority Data

Dec. 2, 2013 (IT) ..... MO2013A000328

(51) Int. Cl.
*B65B 7/20* (2006.01)
*B65B 43/39* (2006.01)
*B65B 21/02* (2006.01)

(52) U.S. Cl.
CPC ..... *B65B 7/20* (2013.01); *B65B 43/39* (2013.01); *B65B 21/02* (2013.01)

(58) Field of Classification Search
CPC ..... B65B 7/20; B65B 43/39; B65B 21/02
USPC ..... 53/376.4
See application file for complete search history.

(56) References Cited

U.S. PATENT DOCUMENTS 3,376,692 A 4/1968 Berney
4,010,597 A * 3/1977 Nelson ..... B65B 51/20 53/376.5
4,124,969 A 11/1978 Peyton
4,191,005 A * 3/1980 Vinoskey ..... B65B 43/39 414/411
4,543,767 A * 10/1985 Wiseman ..... B65B 43/39 53/382.3
4,562,686 A * 1/1986 Focke ..... B31B 1/25 493/183
4,565,050 A * 1/1986 Norris ..... B65B 7/20 53/376.5
4,587,792 A * 5/1986 Hartness ..... B65B 43/39 493/183
5,060,456 A * 10/1991 Wehrli ..... B65B 69/0033 53/381.2
5,102,382 A * 4/1992 Center ..... B31B 3/00 493/1
5,573,490 A * 11/1996 Steinbrenner ..... B65B 43/39 493/183

(Continued)

FOREIGN PATENT DOCUMENTS

JP S61244719 10/1986

*Primary Examiner* — Sameh Tawfik
(74) *Attorney, Agent, or Firm* — Pearne & Gordon LLP

(57) ABSTRACT

A machine for positioning the flaps of a box, including: a conveying surface, arranged so as to advance one or more boxes along an advancement direction;

a deflecting element, structured so as to tilt two opposite transverse flaps of a box back with respect to the direction of advancement of the boxes, and to tilt two opposite side flaps of the box outwards;

at least one orientating device, structured so as to arrange at least one transverse flap in a substantially vertical position, and at least one grip device, which is movable along the advancement direction and structured so as to grip the transverse flap in the substantially vertical position.

11 Claims, 7 Drawing Sheets

(56) References Cited

U.S. PATENT DOCUMENTS

| | | | | |
|---|---|---|---|---|
| 6,070,396 | A * | 6/2000 | Rinaldi | B65B 7/20 493/23 |
| 6,742,647 | B2 * | 6/2004 | De Greef | B65G 17/323 198/470.1 |
| 7,331,156 | B2 * | 2/2008 | Hartness | B65G 17/323 198/470.1 |
| 8,109,062 | B2 * | 2/2012 | Chase | B65B 7/20 53/377.2 |
| 2001/0027825 | A1 * | 10/2001 | Reinecke | B65G 17/326 141/168 |
| 2006/0070850 | A1 * | 4/2006 | Hartness | B65G 17/323 198/468.2 |
| 2009/0290961 | A1 * | 11/2009 | Langston | B65B 5/04 414/222.01 |

* cited by examiner

MACHINE FOR POSITIONING THE FLAPS OF A BOX

FIELD OF THE INVENTION

The object of the present invention is a machine for positioning the flaps of a box.

DESCRIPTION OF RELATED ART

There is a known process for packaging bottles in boxes that comprises the use of the same boxes for transporting the empty bottles from the bottle production plants to the bottling and packaging plants, as well as for the subsequent packaging of the filled bottles. The boxes are preferably made of corrugated cardboard.

In this process, the empty bottles are inserted, upside down, in boxes designed to contain a given number thereof, typically six or twelve bottles arranged in two rows of three bottles each or three rows of four bottles each, per box, or even a larger number of bottles. Suitable dividers that keep the bottles separated from each other can be arranged inside the boxes.

The boxes with empty bottles are left with the upper flaps not glued. Upon reaching the bottling plant, the boxes containing empty upside-down bottles are turned over with the upper flaps downwards. By means of specially structured manipulators, the bottles are taken out of the box, now right side up, and are directed to a bottling line. The empty boxes, with the upper flaps open and facing upwards, are sent to a packaging line, along which a machine arranges the upper flaps in a wide open position so as to permit insertion of the filled bottles in the boxes from above. Repositioning of the flaps is necessary as the fold lines of the flaps are unstiffened and the flaps tend to take on an undefined position.

By means of rather complex mechanisms, the machines of a known type open the upper flaps of the boxes by rotating them to a position tilted outwards. This means that the boxes cannot be positioned close to each other and thus overall, a rather long line is required for the insertion of the bottles inside the boxes. Moreover, the machines of a known type are structured for a specific box size, and they can be adapted for boxes of a different size only at the cost of difficult modifications.

BRIEF SUMMARY OF THE INVENTION

The aim of the present invention is to offer a machine for positioning the flaps of a box that makes it possible to overcome the drawbacks of the currently available machines.

One advantage of the machine according to the present invention is that it makes it possible to keep the boxes close to each other.

Another advantage of the machine according to the present invention is that it can be adapted in a very simple manner for the processing of boxes of different sizes.

BRIEF DESCRIPTION OF THE DRAWINGS

Further characteristics and advantages of the present invention will become more apparent from the following detailed description of an embodiment of the invention at hand, which is illustrated by way of non-limiting example in the accompanying drawings, in which:

FIG. 5 shows the machine appearing in FIG. 4 from a viewpoint located on the opposite side of the machine;

DETAILED DESCRIPTION OF THE INVENTION

The machine for positioning flaps according to the present invention is particularly suited for operation on boxes (B), each of which having two opposite transverse flaps (F1,F2) on the upper part, one at the front and one at the rear, with respect to the direction of advancement (X), and that are rotatable with respect to a respective transverse wall of the box (B) about joining edges that are perpendicular with respect to the direction of advancement (X). The boxes (B) also have two opposite side flaps (F3,F4), which are rotatable, with respect to a respective lateral wall of the box (B), about joining edges that are parallel with respect to the direction of advancement (X). The transverse and side flaps (F1,F2,F3,F4) border an upper opening of the box, through which the bottles or articles to be packaged will be inserted. The flaps (F1,F2,F3,F4) can be folded over at the joining edges thereof in a closed position, in which they are arranged horizontally and, overlapping each other, they close the box (B). The boxes (B) can be made of cardboard for example.

The machine according to the present invention comprises a conveying surface (2), arranged so as to advance one or more boxes (B) along an advancement direction (X). A deflecting element (3) is positioned above the conveying surface, at such a height that it can come into contact with the upper flaps (F1,F2,F3,F4) of the boxes (B) travelling on the conveying surface (2).

Figure 1:
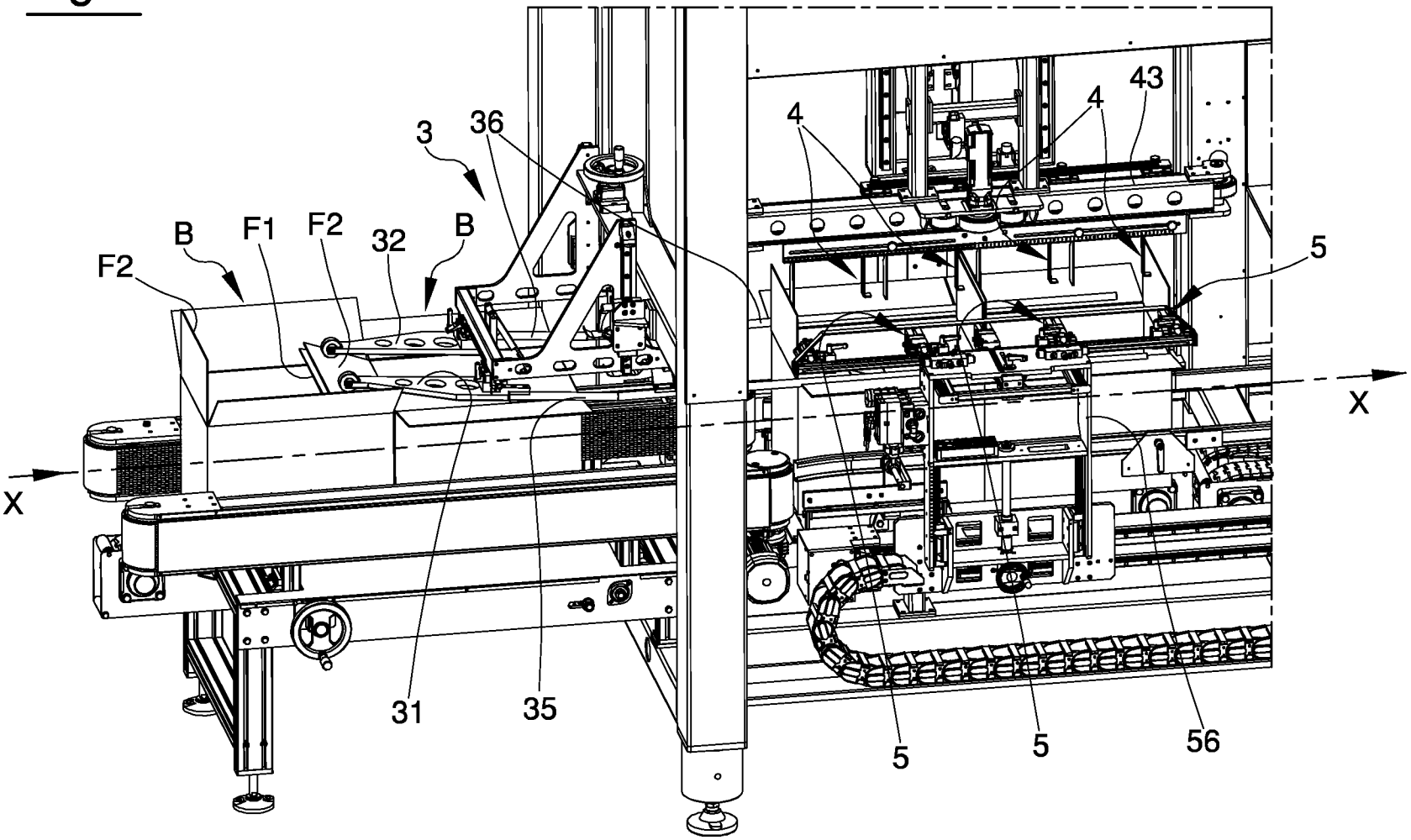
FIG. 1 shows a schematic view of the machine according to the present invention.

The deflecting element (3) is structured so as to tilt the transverse flaps (F1,F2) back with respect to the direction of advancement of the boxes, and, preferably, to tilt the opposite side flaps (F3,F4) outwards, as shown in FIG. 1. The deflecting element (3), which is known to the person skilled in the art, substantially comprises two arms (31,32) arranged above the conveying surface (2) and inclined so as to move apart from each other in the direction of advancement (X). The arms (31,32) come into contact with the upper flaps (F1,F2,F3,F4), flattening the transverse flaps (F1,F2) back and extending the transverse flaps (F3,F4) outwards. After having passed beyond the deflecting element (3), the flaps (F1,F2,F3,F4) tend to rotate in an opposite direction with respect to the direction of rotation determined by the deflecting element, returning to a position that is not well defined. The side flaps (F3,F4) are directed by the deflecting element (3) so as to be arranged below a guide element (35,36) that is arranged substantially parallel to the advancement direction (X) and keeps them in a position that is laterally tilted outwards with respect to the box (B).

The function performed by the deflecting element (3) is substantially that of providing the transverse flaps (F1, F2) with an approximate orientation to the back with respect to the direction of advancement (X). This function could also be performed by other means, for example by a jet of compressed air or by other instruments available to the person skilled in the art. The function of tilting the side flaps (F3,F4) outwards could also be performed with the aid of other means, which are available to the person skilled in the art in this case as well.

The machine according to the present invention further comprises at least one orientating device (4), which is structured so as to arrange at least one transverse flap (F1,F2) in a substantially vertical position. A grip device (5), which is movable parallel to the direction of advancement (X), is structured so as to grip the transverse flap (F1,F2) in the substantially vertical position in which it is positioned by the orientating device (4).

The orientating device (4) and the grip device (5) essentially make it possible to position and keep a transverse flap (F1,F2) of a box (B) in a vertical position. Moreover, the grip device (5) can also be used to move the box (B) being advanced along the longitudinal direction (X) to a position in which a specific device, which is not illustrated herein, inserts from above a given number of bottles or articles inside the box. Kept in the vertical position, the transverse flap (F1,F2) does not interfere with the insertion of the bottles from above. In the case in which one is working on only one box at a time, the transverse flap that is tilted by the orientating device (4) and gripped by the grip device (5) is the front transverse flap (F1), as this flap is deflected back by the deflecting element (3), thus being partially located above the opening of the box (B). The rear transverse flap (F2) is instead deflected back, but it is outside the area of the opening of the box.

Figure 4:
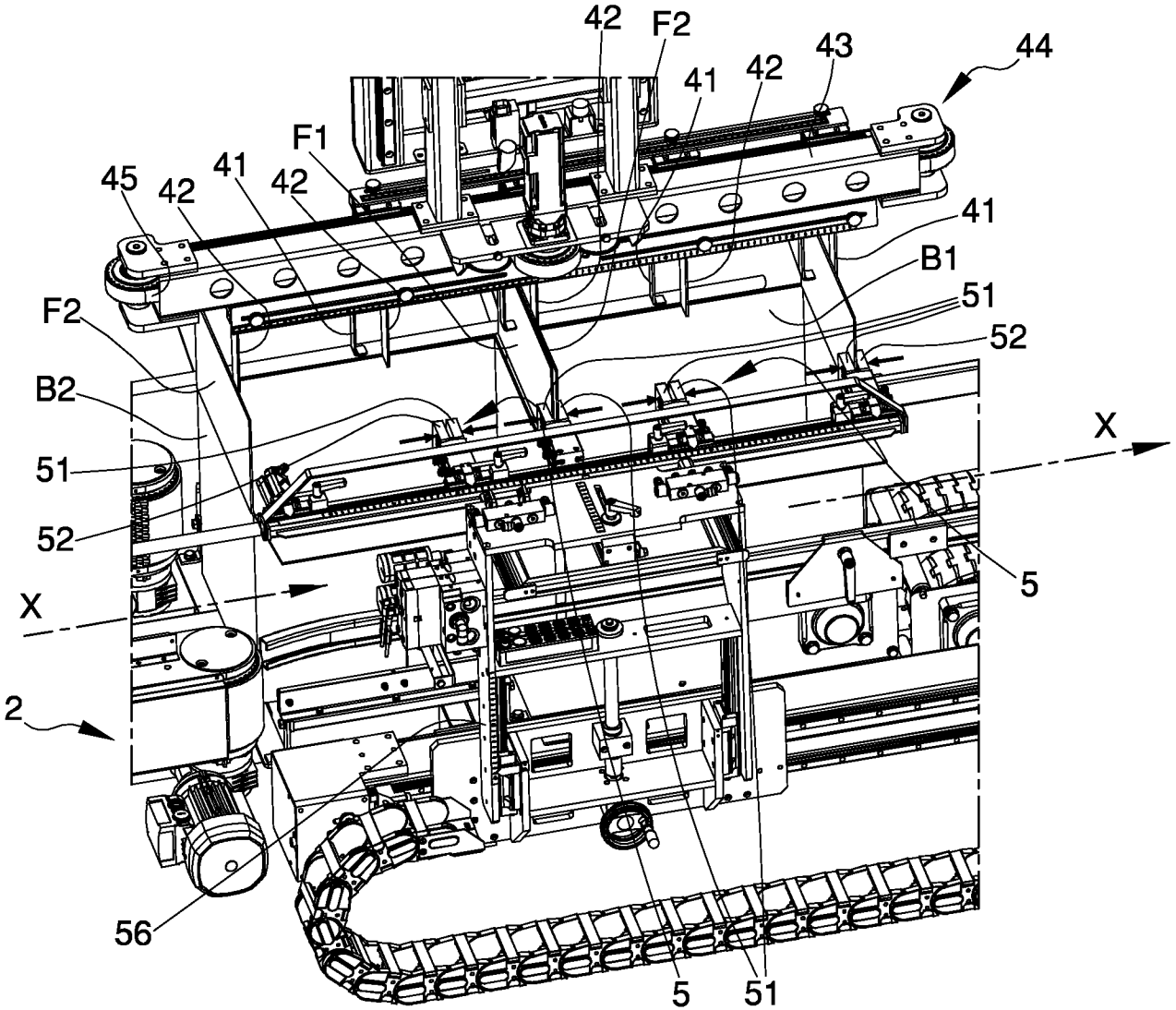
Figure 5:
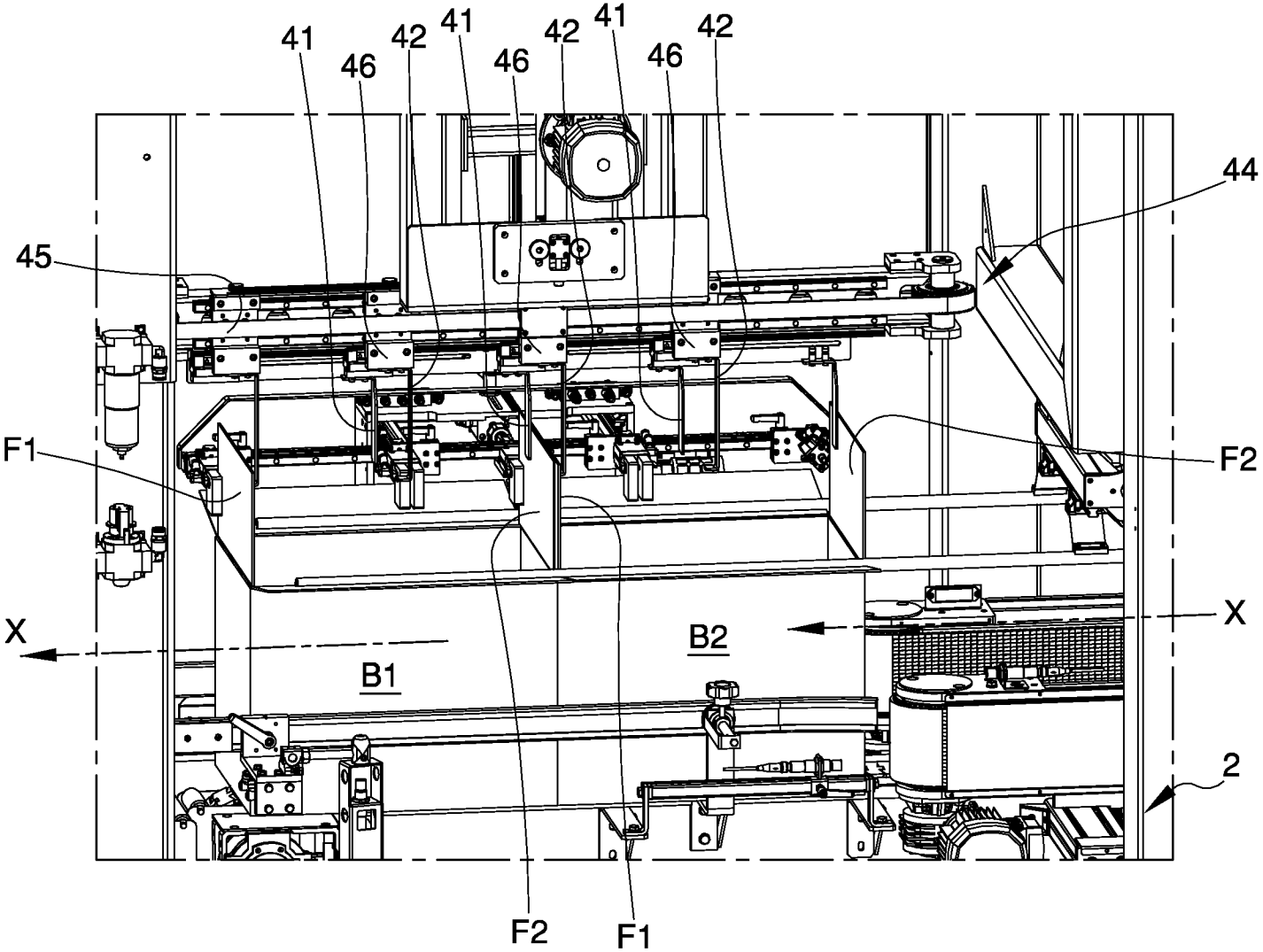
Figure 6:
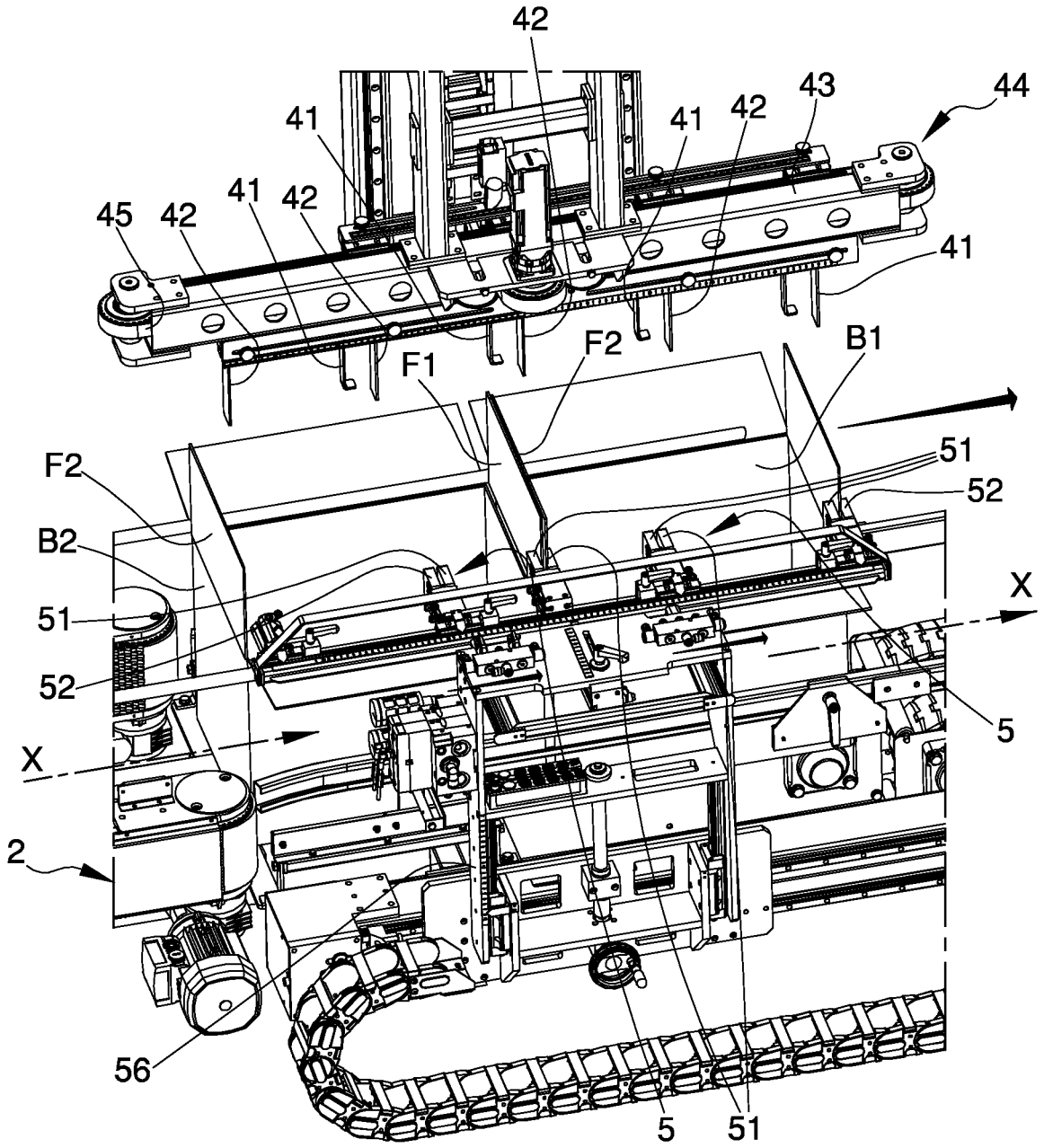
Figure 7:
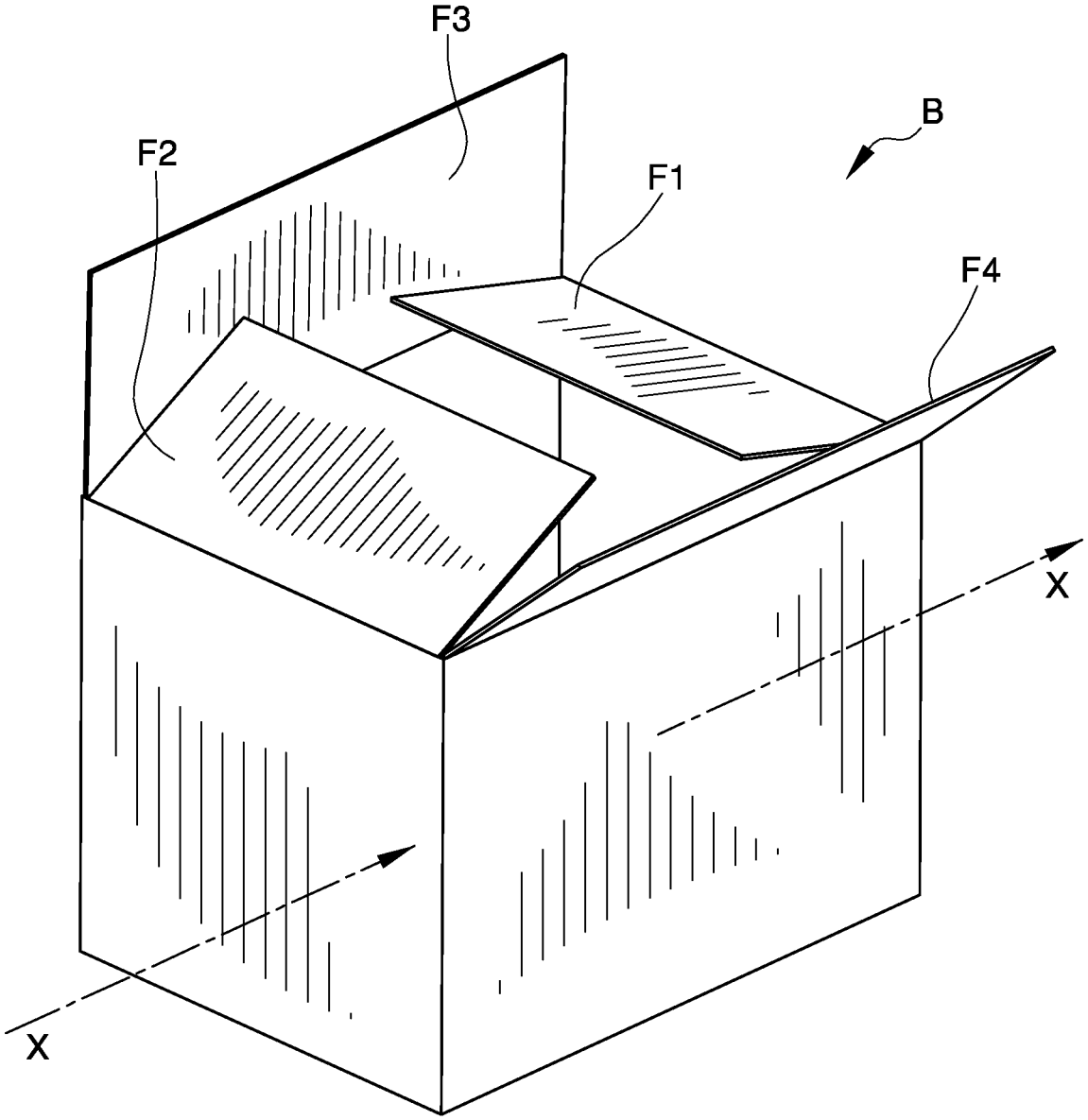
FIG. 7 shows a schematic view of a box that can be processed by the machine according to the present invention.

Moreover, an orientating device (4) and a grip device (5) according to the present invention can operate on two boxes (B1,B2) that are close to each other along the direction of advancement (X) at a transverse wall, as can be seen in FIGS. 4, 5 and 6. The box (B1), which is in a front position, has the rear transverse flap (F2) tilted back and partially over the box (B2) in the rear position, which has its front transverse flap (F1) equally tilted back over its own opening. The orientating device (4) is structured so as to arrange both the front transverse flap (F1) of the rear box (B2) and the rear transverse flap (F2) of the front box (B1) in a substantially vertical position. The grip device (5) is, in turn, structured so as to grip both flaps (F1,F2) of the two boxes (B1,B2) that are close to each other in the substantially vertical position, and thus also so as to advance the two boxes simultaneously to the position for insertion of the bottles. In this case, the bottles can be packaged in two boxes simultaneously.

The machine according to the present invention can be supplied with a number of orientating devices (4) and a number of grip devices (5) depending on the number of boxes (B) close to each other in a sequence that one wishes to package simultaneously. In general, it suffices to arrange an orientating device (4) and a grip device (5) for the front transverse flap (F1) of the box (B) in the most advanced position on the line, and an orientating device (4) and a grip device (5) for each pair of boxes (B) that are close to each other. In fact, each device (4,5) is capable of manipulating the two transverse flaps (F1, F2), found alongside each other, of two consecutive boxes, as described hereinabove.

In a preferred embodiment, the orientating device (4) comprises a first element (41), which is movable along a substantially vertical direction between a lower position, in which it is found at a given distance with respect to the conveying surface (2), and an upper position, in which it is found at a further distance from the conveying surface (2). In the upper position, the first element (41) interferes slightly with the upper flaps (F1,F2) of the boxes (B), thereby contributing to tilting them back, that is, in a direction opposite the direction of travel. In the lower position, the first element (41) can come into greater contact with the flaps (F1,F2).

The orientating device (4) further comprises a second element (42), opposite the first element (41) and movable parallel to the first element (41) along a substantially vertical direction between the lower and upper positions. The second element (42) is also movable along a direction parallel to the advancement direction (X) between a distanced position, in which it is found at a given distance from the first element (41), and a close position, in which it is found at a shorter distance from the first element (41). The second element (42) is located upstream of the first element (41) with respect to the advancement direction (X), as the transverse flaps (F1,F2) are tilted back by deflecting element (3).

Figure 2:
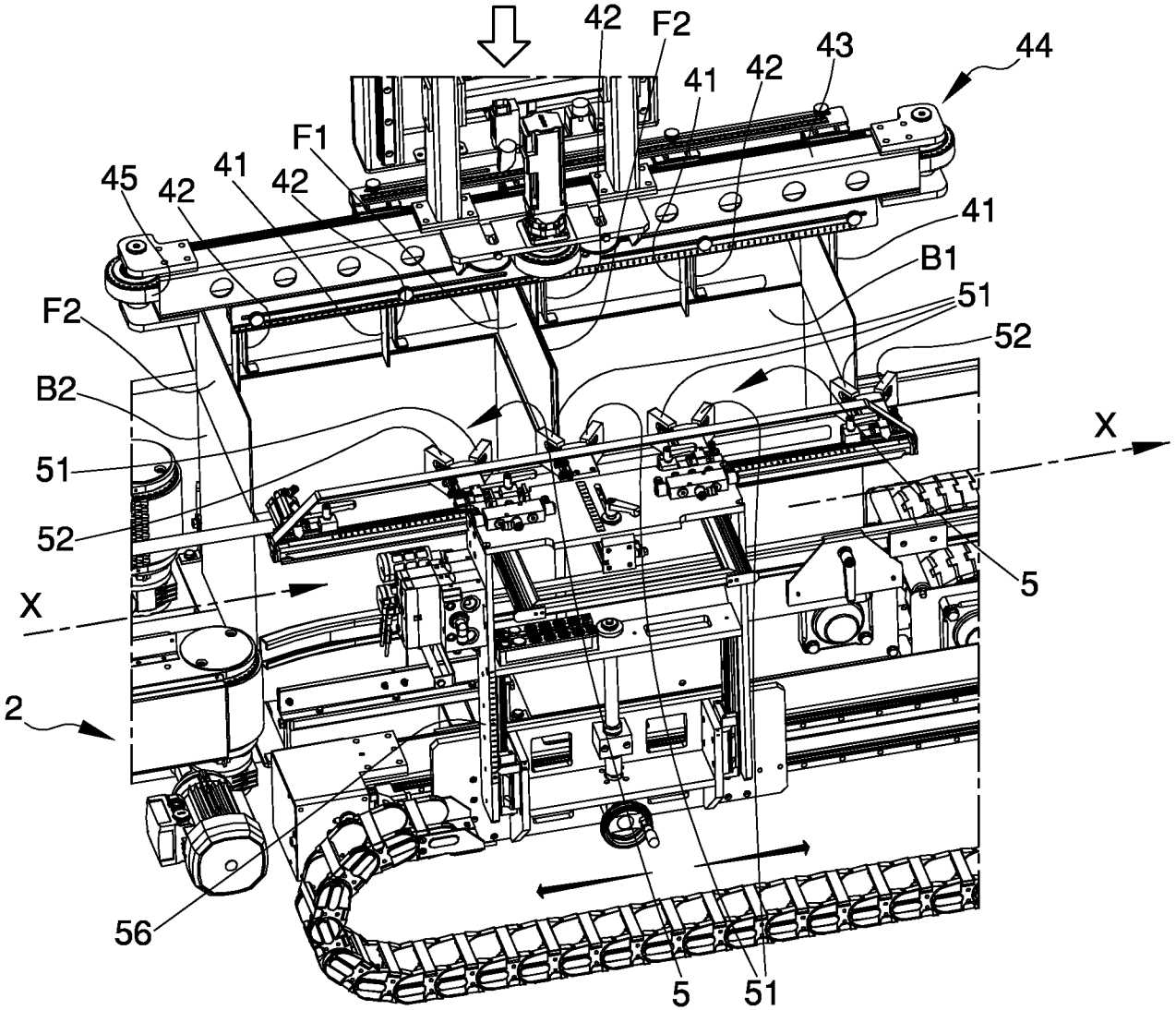
FIGS. 2 to 6 show the machine according to the present invention in various stages of operation.
Figure 3:
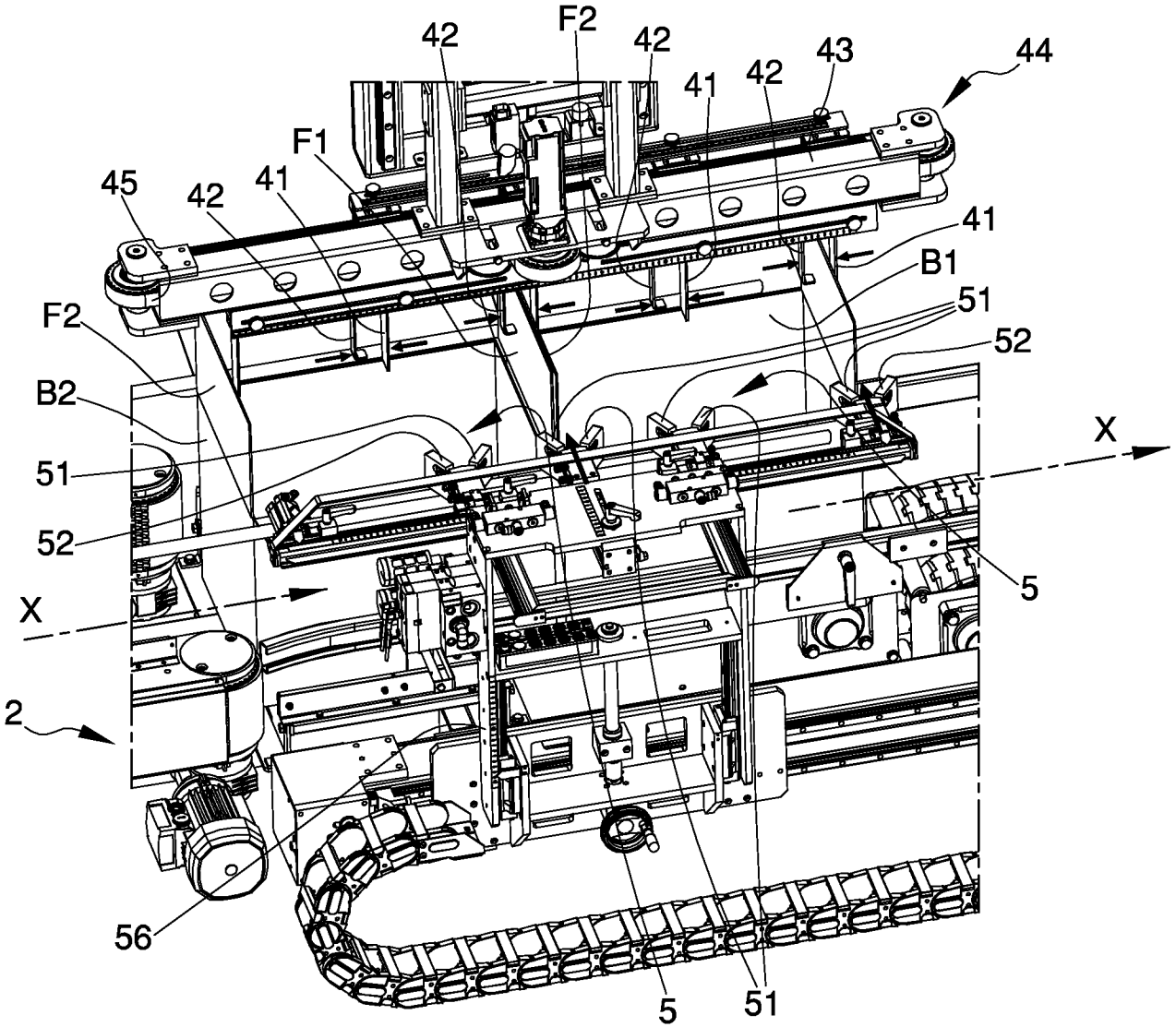

As shown in FIG. 2, in an initial configuration, the first and the second elements (41,42) are found in an upper position and the second element (42) is in its distanced position. From this initial configuration, the first and the second elements (41,42) descend into the lower position, and upon reaching this lower position, the second element (42) moves into its close position, approaching the first element (41) (FIG. 3). At the same time, the orientating device (4) rises, providing the second element (42) with an overall curved path deriving from the combination of the vertical upward movement and the horizontal movement for approaching the first element (41). This curved path, which is substantially a circular arc path, follows the natural rotation movement opening the flaps (F1,F2). Moving towards its close position, the second element (42) comes into contact with the front transverse flap (F1) of the rear box (B2), rotating it forwards in an upward direction. The front transverse flap (F1) of the rear box (B2), in turn, comes into contact with the rear transverse flap (F2) of the front box (B1), rotating it forwards in an upward direction. In the close position of the second element (42) both the front and rear transverse flaps (F1,F2) of the two boxes close to each other are found in a substantially vertical position (FIG. 3). Following the movement towards the upper position of the first and the second elements (41,42), the grip device (5) grips the two transverse flaps (F1,F2), pressing them one against the other and keeping them in a vertical position (FIGS. 4,5, and 6).

The grip device (5) comprises a pair of gripping elements (51, 52), which are movable between a gripping position, in which they are close to each other and can grip at least one flap (F1,F2) between each other, and a releasing position, in which they are distanced from each other and can release the flap (F1,F2). Essentially, the grip device (5) is in the form of a pair of pliers and it is not described in detail as it is known to the person skilled in the art.

The gripping elements (51,52) are movable along a direction transverse to the advancement direction (X) between a retreated position, in which they are at a given distance from the conveying surface (2), and an advanced position, in which they are at a shorter distance from the conveying surface (2) and can come into contact with the transverse flaps (F1,F2).

Starting from an initial position in which the grip device (5) is found in the retreated position aligned with an orientating device (4) along a direction perpendicular to the advancement direction (X) with the gripping elements (51, 52) in a releasing position (FIGS. 2 and 3), and in which the transverse flaps (F1,F2) of the close boxes (B1,B2) are in a substantially vertical position following the action performed by the orientating device (4), the grip device (5) moves towards the advanced position, in which the two close transverse flaps of the two adjacent boxes (B1,B2) are arranged between the gripping elements (51,52) (FIG. 4). Subsequently, the gripping elements (51,52) close together and the grip device (5) moves ahead, dragging the boxes (B1,B2) forwards. Once the predetermined forward travel is completed, the gripping elements (51,52) move into the releasing position, and the grip device (5) moves into the retreated position and completes a return travel path along the direction of advancement (X) back to the initial position, from which it resumes a new cycle of operations.

The operations described for an orientating device (4) and for a grip device (5) can be carried out simultaneously and in a synchronized manner by additional orientating devices (4) and grip devices (5) present in the machine, so as to work on a number of boxes (B) simultaneously. The orientating devices (4) and grip devices (5) can all be simultaneously active, or, based on the size of the boxes (B) and the number of boxes (B) to be processed simultaneously, some of the devices (4,5) can be kept in an inoperative state.

In a preferred embodiment, the orientating device (4) comprises a support (43), which is movable along a substantially vertical direction and with which the first element (41) is associated. The support (43) is preferably in the form of a section bar and arranged in a position parallel to the direction of advancement (X). All the first elements (41) of the orientating devices (4) present are associated with the support (43) and spaced by pitches that are adjustable according to the dimensions of the boxes (B) to be processed. The support (43) can be moved vertically by one or more actuators, which are not illustrated in detail.

A motor element (44) is associated with the support (43) so as to translate the second element (42) between the distanced and the close positions. This motor element (44) is predisposed to translate the second elements (42) of all the existing orientating devices simultaneously.

The motor element (44) preferably comprises a motor-driven belt (45), which is movable in opposite directions in a direction parallel to the advancement direction (X), and an attachment body (46) solidly constrained to the belt (45) and to the second element (42). The second elements (42) of all the existing orientating devices (4) are associated with the motor-driven belt (45) by means of respective attachment bodies (46), which are separated by pitches that are adjustable according to the dimensions of the boxes to be processed. The motor-driven belt (45) is activated by an actuator equipped with a pulley; the actuator is not illustrated in detail as it is known to the person skilled in the art.

The grip device (5) is associated with a frame (56) that is slidable in alternate directions along a direction parallel to the advancement direction (X). The grip device (5) is slidable with respect to the frame (56) between its retreated and advanced positions by an actuator that is not illustrated in detail. As shown in FIGS. 1 and 2, the frame (56) supports all the grip devices (5) with which the machine is supplied. The frame (56) is slidable along a guide arranged parallel to the advancement direction (X) and it is movable by an actuator that is not illustrated in detail.

The invention claimed is:

1. A machine for positioning flaps of a box, comprising: a conveying surface (2) advancing the box (B) along an advancement direction (X); wherein the machine comprises at least one orientating device (4) having one or more elements which orient at least one transverse flap (F1,F2) of the box (B) in a substantially vertical position, and at least one grip device (5), which is movable along the direction of advancement (X) and which grips the transverse flap (F1,F2) in a substantially vertical position, wherein the grip device (5) is adapted and effective to grip the transverse flap (F1, F2) and move the box (B) along the advancement direction (X), the grip device (5) comprising a pair of gripping elements (51, 52) which are movable to a gripping position where they can effectively grip the transverse flap (F1, F2), in the gripping position the gripping elements (51, 52) being oriented to grip a planar transverse flap extending in a direction transverse to the advancement direction (X).

2. The machine according to claim 1, wherein the orientating device (4) comprises: a first element (41), which is movable along a substantially vertical direction between a lower position, wherein it is found at a given distance with respect to the conveying surface (2), and an upper position, wherein it is found at a further distance from the conveying surface (2); a second element (42), opposite the first element (41) and movable parallel to the first element (41) along a substantially vertical direction between the lower and upper positions and along a direction parallel to the advancement direction (X) between a distanced position, wherein it is found at a given distance from the first element (41), and a close position, wherein it is found at a shorter distance from the first element (41).

3. The machine according to claim 2, wherein the orientating device (4) comprises a support (43), which is movable along a substantially vertical direction, and with which the first element (41) is associated; a motor element (44), which is associated with the support (43) and arranged so as to translate the second element (42) between the distanced and the close positions.

4. The machine according to claim 3, wherein the motor element (44) comprises a motor-driven belt (45), which is movable in a direction parallel to the advancement direction (X), and an attachment body (46) solidly constrained to the belt (45) and to the second element (42).

5. The machine according to claim 1, wherein the pair of gripping elements (51, 52) are movable between the gripping position, wherein they are close to each other and can grip at least one transverse flap (F1, F2) between each other, and a releasing position, wherein they are distanced from each other and can release the transverse flap (F1, F2).

6. The machine according to claim 5, wherein the gripping elements (51, 52) are movable along a direction transverse to the advancement direction (X) between a retreated position, wherein they are at a given distance from the conveying surface (2), and an advanced position, wherein they are at a shorter distance from the conveying surface (2) and can come into contact with the transverse flaps (F1, F2).

7. The machine according to claim 1, wherein the grip device (5) is connected with a frame (56) that is slidable in alternate directions along a direction parallel to the advancement direction (X).

8. The machine according to claim 1, comprising two or more orientating devices (4) separated by given distances along the advancement direction (X).

9. The machine according to claim 1, comprising two or more grip devices (5) separated by given distances along the advancement direction (X).

10. The machine according to claim 8, comprising two or more grip devices (5) separated by given distances along the advancement direction (X), wherein each orientating device (4) is aligned with a grip device (5) along a direction perpendicular to the advancement direction (X).

11. The machine according to claim 6, wherein the grip device (5) is adapted and effective to move the box (B) along the advancement direction (X) when the gripping elements (51, 52) are in the advanced position.

* * * * *